United States Patent [19]

Frehner

[11] 4,278,364

[45] Jul. 14, 1981

[54] RETAINING TIES

[76] Inventor: Stanford Frehner, c/o S. & F. Sales, P.O. Box 15338, Salt Lake City, Utah 84115

[21] Appl. No.: 68,903

[22] Filed: Aug. 23, 1979

[51] Int. Cl.[3] ..... E02D 17/00

[52] U.S. Cl. ..... 405/273; 405/284

[58] Field of Search ..... 405/284, 285, 272, 273; 52/606, 607, 611, 612

[56] References Cited

U.S. PATENT DOCUMENTS

| | | | |
|---|---|---|---|
| 1,907,053 | 5/1933 | Flath | 405/273 |
| 1,909,539 | 5/1933 | Huntoon | 405/273 |
| 2,159,556 | 5/1939 | Habicht | 405/273 |
| 2,197,960 | 4/1940 | Alexander | 405/273 |
| 2,315,441 | 3/1943 | McDaniel | 405/273 |
| 2,960,797 | 11/1960 | Frehner | 405/284 |
| 2,972,870 | 2/1961 | Cooper | 405/273 |
| 3,269,125 | 8/1966 | Moore | 405/15 |
| 3,631,682 | 1/1972 | Hilfiker | 405/273 |

FOREIGN PATENT DOCUMENTS

| | | | |
|---|---|---|---|
| 533805 | 10/1955 | Italy | 405/273 |
| 908901 | 7/1960 | United Kingdom | 405/273 |

*Primary Examiner*—Dennis L. Taylor

*Attorney, Agent, or Firm*—Harvey B. Jacobson

[57] ABSTRACT

A retaining tie system is designed and engineered to stack, nest and interlock without mortar. The system includes an anchor block which is formed in a T-shape with the head of the T adapted to extend backward into a hillside and act as an anchor for the system. A plurality of stringer blocks lie horizontally along the face of the hillside between the retaining blocks. Corner tie blocks are notched to intersect one another forming 90° angles and are used in conjunction with each other in positions to form either inside or outside corner turns. The system can be used for terracing and stepping backward or forward, and for stepping up and down to fit different grades of the hillside. All the blocks interlock with one another to form a permanent, self-sustaining structure.

4 Claims, 9 Drawing Figures

RETAINING TIES

BACKGROUND OF THE INVENTION

1. Field of the Invention

This invention relates to building constructions and especially to prefabricated building blocks adapted for the construction of retaining walls.

2. Discussion of Related Art

In the landscaping of private residential, industrial, commercial and public properties there are often hillsides to be considered. While some hillsides can be and often are seeded to grass or planted with ground cover of shrubs, there are many instances where the steepness of the hillside precludes any such type of planting. Steep slopes of all kinds offer an exciting opportunity for unique planting effect, but excessive water run off and consequent undesirable soil erosion prohibits such planting unless accompanied by the use of a retaining wall structure. As well as providing a more level area for planting and living space, retaining walls are often used by property owners to define the boundaries between adjoining properties. For these and other reasons, architects, builders, landscape architectors, contractors and home owners all desire to control the hillside with a structurally sound, strong retaining wall and to provide more beautiful landscape planting.

Included in the many suggested forms of retaining blocks are those shown in U.S. Pat. No. 2,960,797, issued Nov. 22, 1960 to Frehner. The Frehner patent discloses a system of identical blocks which are used in single block heights and terraced back for the next level of block. U.S. Pat. No. 3,269,125, issued Aug. 30, 1966, to Moore, shows a hillside stabilizing construction comprising header blocks and stretcher blocks which are disposed in an interconnected manner to produce a terrace retaining wall structure wherein the different levels are held together and affixed to the ground by means of steel rods which extend through openings in the various blocks into the surrounding earth. U.S. Pat. No. 3,389,499, issued June 25, 1968, to Haile, shows a system of open bottom box-type blocks that stack vertically to form a free-standing wall which acts as a divider or screen and in which vegetation may be planted to enhance the aesthetic appeal of the device. U.S. Pat. No. 3,503,589, issued Mar. 31, 1970, to Moore, shows a construction unit having at least one vertically elongated wooden or concrete post of relatively small cross-sectional area that is sunk into the ground and fixed to a wide panel by the use of nails, nuts and bolts, glue, liquid asphalt, or the like.

SUMMARY OF THE INVENTION

One object of the present invention is to provide a retaining tie system comprising a plurality of retaining tie blocks which can be laid up in courses or layers to form an interlocking retaining wall which does not require the use of mortar, bolts, steel rods, or the like to maintain its structural integrity.

A further object of the present invention is to provide a retaining tie system for forming a retaining wall which is structurally sound and aesthetically pleasing and can retain and hold steep hills against the devastating force of water, wind or gravity.

An even further object of the present invention is to provide a retaining tie system which can be installed either vertically or at a tilted/reclined angle against the face of a hillside at an angle of 80° to the horizontal.

An even still further object of the present invention is to provide a retaining tie system which can be built up in terrace levels in a interlocked vertical series of walls going upward on the hillside, or stepping up, or stepping down to the left or right on the face of the wall to fit differences in elevation along the face of the hill.

Yet another still further object of the present invention is to provide a retaining tie system which contains blocks which are capable of performing 90° turns or corners either inside or outside.

Another object of the present invention is to provide a retaining tie system which, when installed in vertical wall series of terraced walls, create wide, long, deep, level planting terraces on which to plant small or large sized plant materials to beautify and hold the hillside.

An even still further object of the present invention is to provide a retaining tie system having blocks incorporating features to form vertical and horizontal columns on the face of each retaining wall with horizontal joint lines creating a matched pattern with the horizontal joint lines or other blocks in the wall to provide contrast and three-dimensional beauty.

In accordance with the above objects, the retaining tie system of the present invention comprises five basic building blocks individual ones of which can be interlocked in vertical arrays by the use of projections and mating grooves formed in the blocks. The first of the blocks is a T-shaped element having an elongated body with a large transverse head formed on one end of the body. The head is embedded in the hill to be retained and forms an anchor for the block and attached members of the system. A smaller transverse head is formed on the opposite end of the body and serves to retain stringer blocks which are made in two lengths. Each of the stringer blocks is an elongated member having the aforementioned projections and grooves running for the entire length of the member. The ends of each stringer block are retained behind the small head of the T-shaped block. By positioning the T-shaped blocks with their small heads defining a convex or concave curve, a curve can be formed by merely placing the stringers between the T-shaped blocks. If it is desired to form a 90° corner, special corner blocks adapted for this purpose are also provided. One corner block has a downwardly opening notch while the other corner block has an upwardly opening notch. The notches are mated and two blocks extend thusly at 90° to each other. The ends opposite the interconnection of these blocks can be retained in the T-blocks in the same manner as the stringers.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 5:
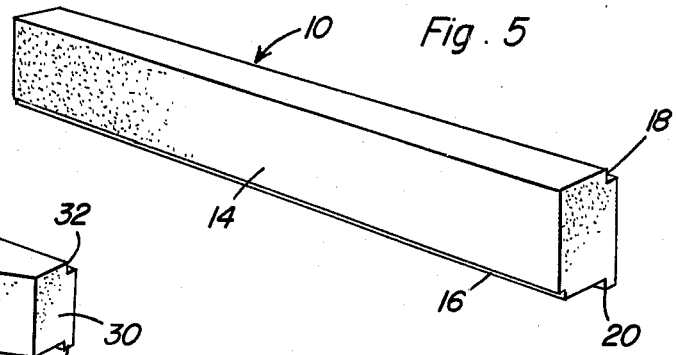
FIG. 5 is a perspective view of one stringer block of the present invention.
Figure 6:
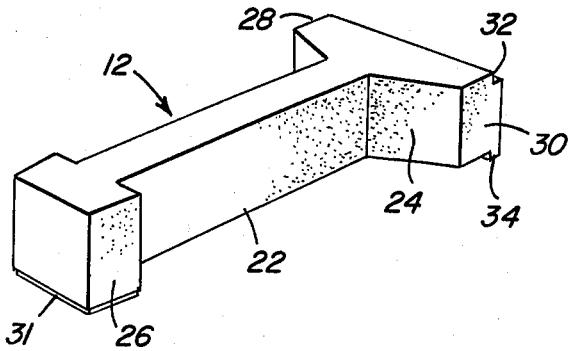
FIG. 6 is a perspective view of the T-shaped anchor block of the present invention.

Initially with reference to FIGS. 5 through 8, the individual retaining ties of the present invention will be described in detail. Preferably, the system comprises five different blocks, with FIG. 5 showing a full stringer retaining tie block generally labelled with the reference numeral 10. Block 10 is the main face block which lies horizontally and parallel along the face of the hillside. Each additional block or course stacks on top of and interlocks with the block on the course below it to form the face of the wall. The blocks are interconnected and held in place by blocks 12 which are shown in FIG. 6 and generally T-shaped. These T-shaped blocks serve to anchor the entire retaining wall into the hill. The full stringer blocks 10 are the longest in length of the retaining ties. Blocks 10 can be made in any length desired, but are preferably formed in six foot lengths in order to make them amenable for use in manual stacking. Each block is formed with a substantially planar front face 14 which has a small indentation 16 formed in the lower portion thereof for cosmetic purposes. The indentation 16 runs longitudinally of the block and extends for the entire length thereof. The purpose of the indentation is to emphasize the horizontal joints between adjacent vertically stacked blocks after the retaining wall is completed. The indentation provides visual aesthetic appeal to the retaining wall by producing a shadow pattern at the various block interconnections. The rear of the block also contains a planar surface and includes an upper longitudinally extending notch 18 which also runs for the full length of the block. A lower depending projection 20 also extends for the entire length of the block and interconnects with notches 18 of an adjacent lower stringer block to secure the various stringer blocks together. The front and back faces of the block 10 are parallel to each other with the indentation 16, notch 18 and depending projection 20 being generally rectangular in shape. A half stringer block is also provided having the exact same characteristics as the full stringer block 10. However, the half stringer block is one-half the length of the full stringer block. This enables the anchor blocks 12 to be spaced at different intervals along the face of a wall to make either a 3 foot, 6 foot, 9 foot or 12 foot section of wall between a column of anchor blocks.

Each anchor block 12 has an elongated generally rectangular body 22 attached at one end to a transverse head comprising the cross of the T and labelled 24. Transverse head 24 is placed into the hillside and acts as an anchor for the entire retaining tie system. A smaller transverse head 26 is attached to the front of the body 22 and serves to hold the other elements of the retaining tie system in a secure structural engagement. The entire block 12 is, preferably, 36 inches in length and 8 inches high. The larger transverse head 24 is 18 inches from end to end and varies in lateral dimension from 3 inches at the ends 28 and 30 tapering forward until it attaches to the body 22. The body 22 itself is 3 inches in width and has a constant cross section throughout. The smaller head 26 is trapezoidal in plan with its larger base connected to the end of the body 22. The larger base of the trapezoid is 8-½ inches in length while the smaller base is 8 inches in length. The smaller head 26 includes a cosmetic indentation shown at 31 which extends around three sides of the head for the purpose as discussed with respect to indentation 16 of block 10. The larger transverse head 24 includes a notch 32 extending across the length of the head and a depending projection 34 is attached to the bottom of the head and extends for the length of the head. Notch 32 is designed to cooperate with projections 34 of other blocks as will be discussed further hereinafter. The smaller head 26 of block 12 helps to retain, hold and interlock into place other blocks of the invention whose ends are placed against the rear surface of the smaller head and abutted against the body 22, as also will be discussed further hereinafter.

Figure 7:
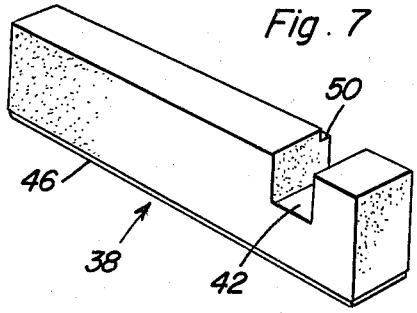
FIG. 7 is a perspective view of one corner block of the present invention.
Figure 8:
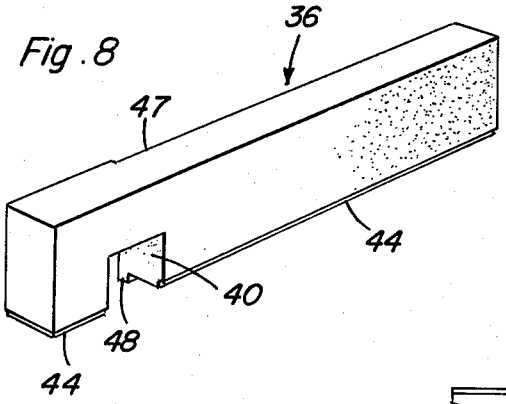
FIG. 8 is a perspective view of another corner block of the present invention.

FIGS. 7 and 8 show the interlocking 90° turn blocks 36 and 38. Each of the blocks 36 and 38 is approximately 43 inches long, 8 inches high and 4-½ inches wide. The front and rear faces of each block are parallel as are the top and bottom surfaces of the blocks. Block 36 has a large rectangular notch 40 cut laterally through it starting at approximately 4 inches from the left end. This notch is designed to interlock with a similar notch 42 of block 38. Notch 42 starts approximately 4 inches from the right end of the block and is cut through the top surface thereof. Accordingly, when notches 40 and 42 are interconnected, the blocks 36 and 38 extend at 90° to each other. Block 36 also has a cosmetic indentation 44 which extends along the front face of the block on both sides of notch 40, laterally along the left end of block 36 and along the rear face of the block approximately 4 inches to the beginning of the notch 40. Similarly, block 38 has a cosmetic indentation 46 which extends completely along the front face of the block along the right side of the block and along the rear face of the block approximately 4 inches to the beginning of notch 42. Block 36 contains an upper notch 47 formed in the rear and upper surfaces of the block for interconnection with other blocks of the invention. Notch 47 extends from the right side of the block, as pictured in FIG. 8, to a position aligned with the right hand side of notch 40. Similarily, the depending projection 48 of that block extends from the right hand side of the block to the right hand side of notch 40. In a similar manner, block 38 contains an upper notch 50 which extends from the left hand side of the block to the beginning of notch 42. Also, block 38 contains a depending projection (not shown) which extends from the left hand side of the block to the left hand side of notch 42.

It is preferable that the retaining tie blocks be manufactured from a strong concrete mixed design with steel reinforcing for stabilization and strength of the blocks. However, the blocks can also be manufactured of wood, metal, plastic, fiberglass, or other materials that can be shaped or molded according to the above discussed block configurations. Also, the dimensions discussed in relation to each block are preferable for the production of steel reinforced concrete blocks which can be manually manipulated. Of course, other dimensions can be used and larger blocks can be produced for use with mechanized placing equipment.

Figure 1:
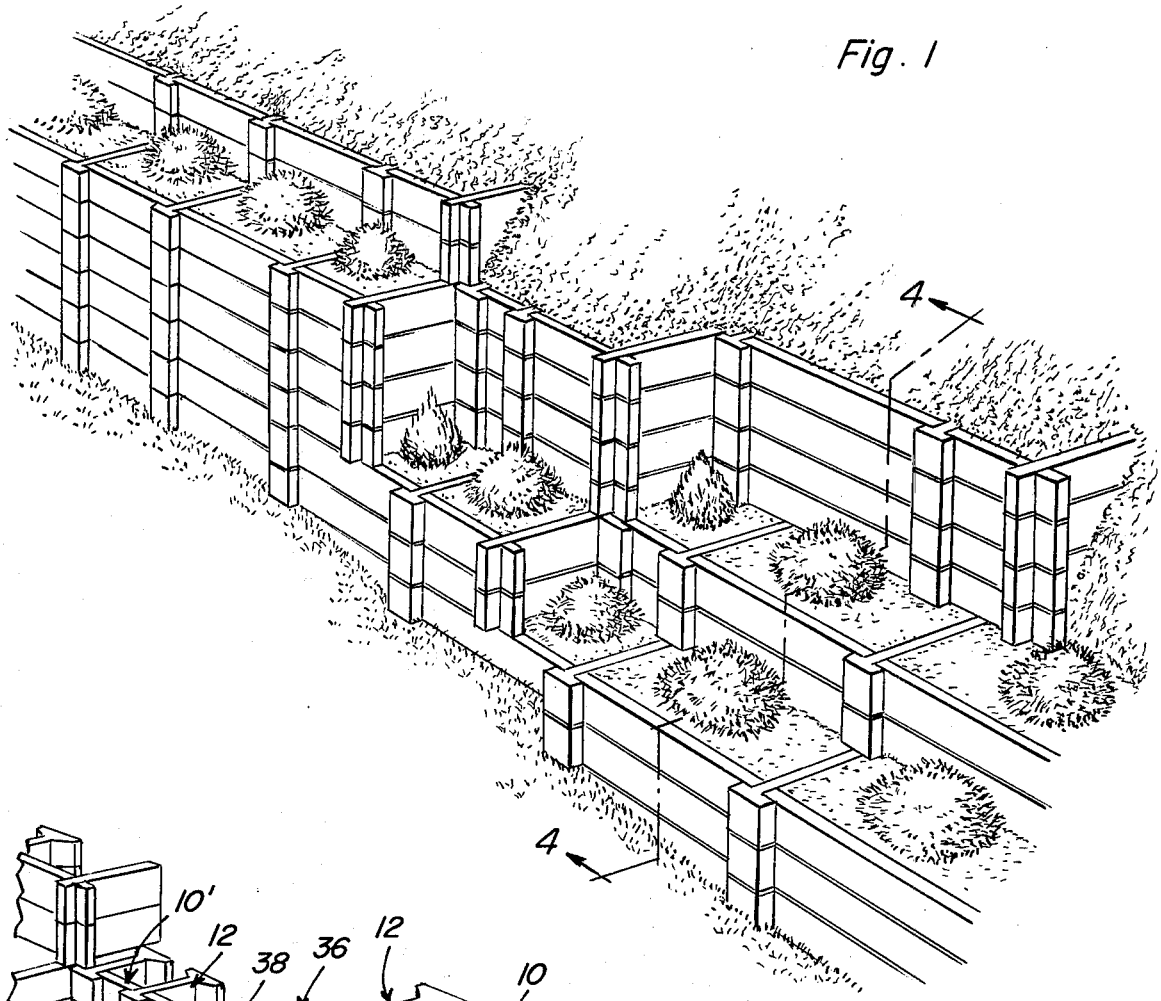
FIG. 1 is a perspective view of a retaining wall using the retaining ties of the present invention.
Figure 2:
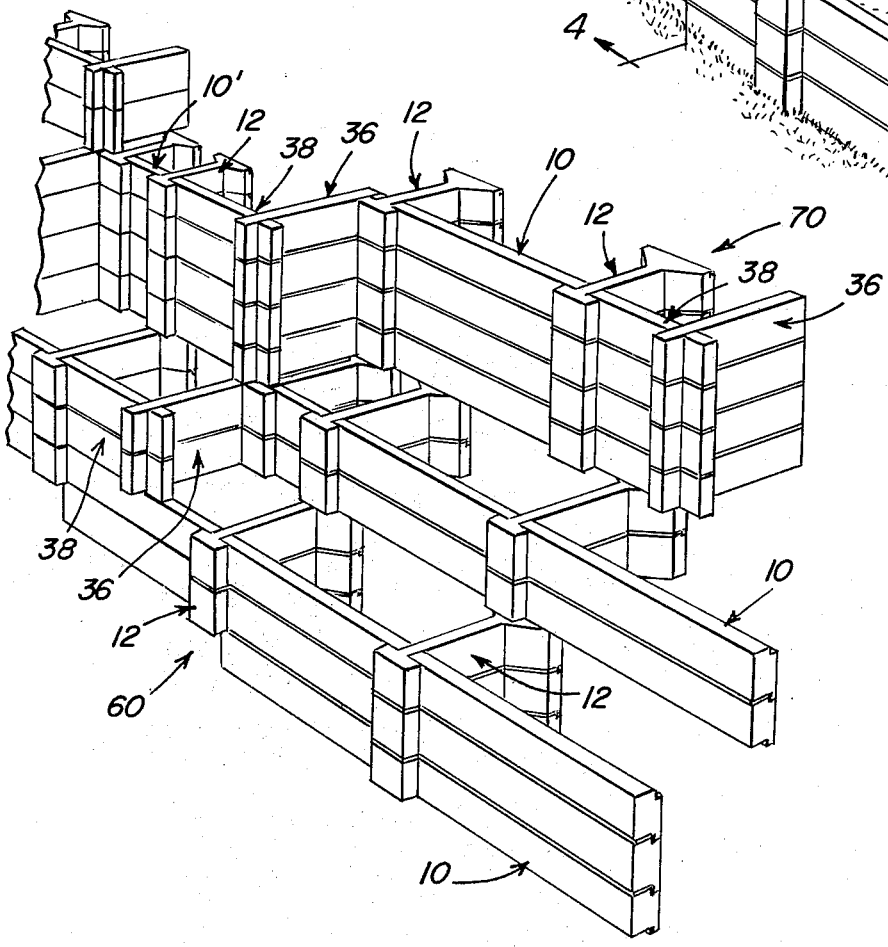
FIG. 2 is a perspective view of the retaining wall of FIG. 1 with the soil removed to better illustrate the block interconnections.
Figure 3:
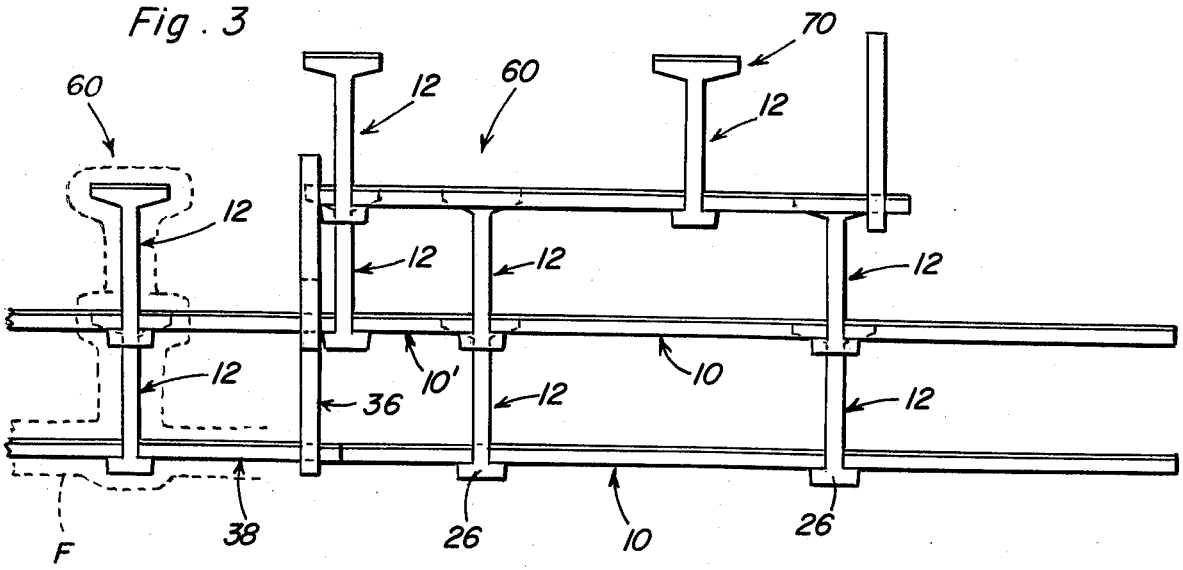
FIG. 3 is a top plan view of the retaining wall structure of FIG. 2.
Figure 4:
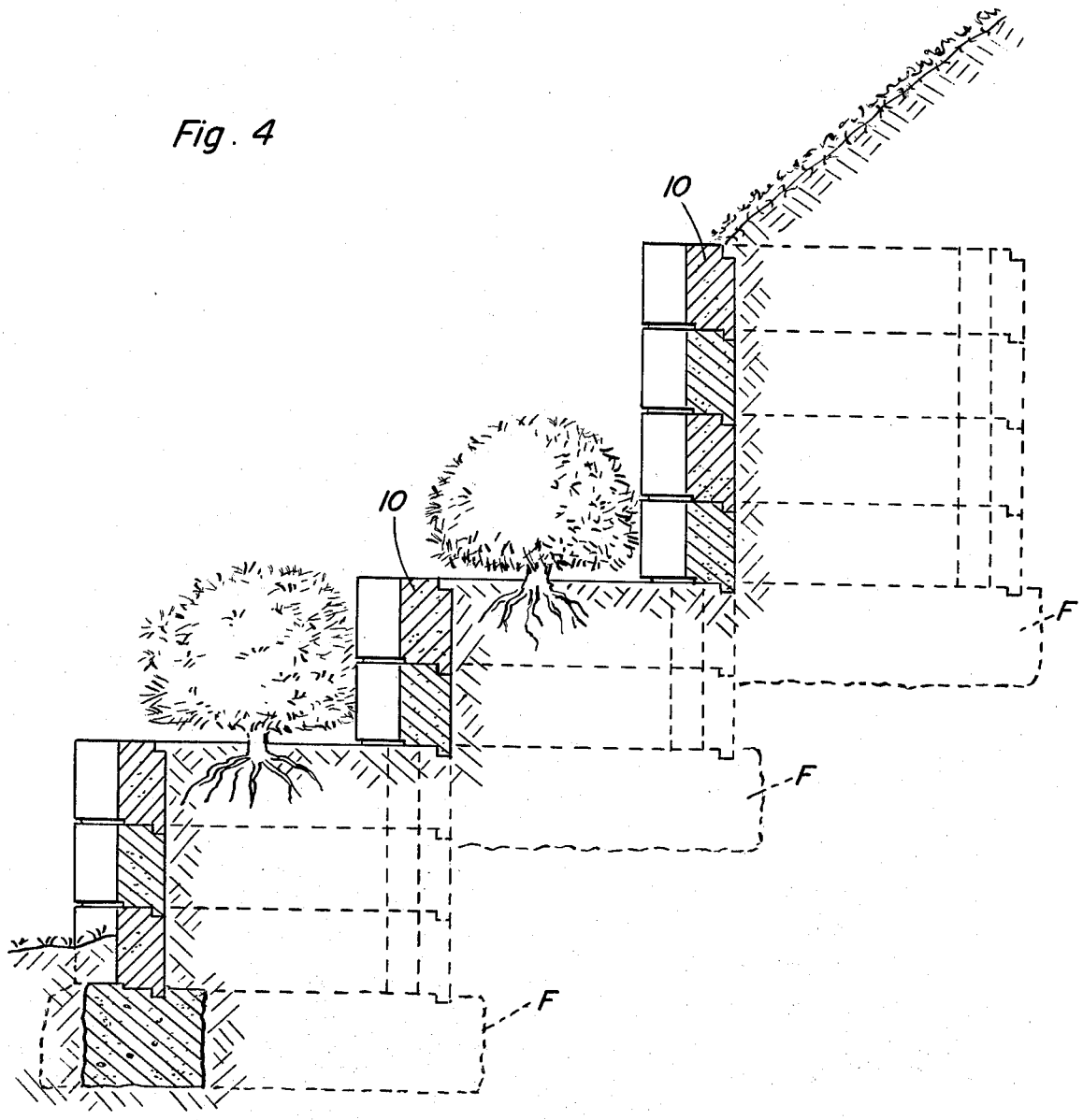
FIG. 4 is a side elevational sectional view taken substantially along a plane passing through section line 4—4 of FIG. 1.

Now, with reference to FIGS. 1 through 4, a description of one retaining wall which can be produced by the use of the retaining ties of the present invention will be discussed in detail. FIG. 1 shows a completed retaining wall which has been back filled and suitably planted with grass, shrubs, and the like. The retaining wall of FIG. 1 is built having various terrace levels extending rearwardly of the wall up the slope of the retained hillside and longitudinally of the wall along the base of the hillside. FIGS. 2, 3 and 4 show the manner in which the retaining wall of FIG. 1 is interconnected. First, footings F are poured beneath the position to be occupied by each level of the retaining wall. Then, the anchor blocks 12 are placed on the footings and stacked vertically to the desired height. These stacks of anchor blocks are spaced along each level of the retaining wall at intervals equivalent to the length of stringer blocks 10 or half stringers 10'. The stringer blocks and half stringers are positioned behind the heads 26 abutting the bodies of the anchor blocks. At the termination of any particular level, paired 90° angle blocks 36 and 38 are used to form an inward turning wall to terminate the level. Rearwardly succeeding higher levels can be formed by placing anchor blocks 12 of the rear level in alignment with the anchor blocks in the lower forward level, as shown generally at 60. In this configuration, the rear level anchor tie would have its smaller forward head moved forwardly onto the body of the lower forward tie by a sufficient amount to allow the lower projections of the stringer blocks 10 to engage the notches of the large transverse heads of the lower anchor blocks to insure secure structural engagement of the various levels. Of course, if desired, the rear anchor blocks can be offset from the forward anchor blocks, as shown generally at 70. In this case, the rear anchor blocks would not rest on forward anchor blocks, but would still be positioned such that the stringers 10 and and half stringers 10' would engage the lower forward anchor blocks as discussed. As each level is completed, it may be back filled and compacted whereby the stringer blocks will be securely positioned against the small heads of the anchor blocks and the level will be firmly secured. Obviously, the size of each specific planting area can be varied in accordance with the size of the stringer used and positioning of the anchor blocks. If desired, the distance between anchor blocks can be extended by building the stringer block wall in an alternating brick-like fashion between the anchor blocks. In this manner, distances of 9 feet, 12 feet, or more, can be established between adjacent anchor blocks.

Figure 9:
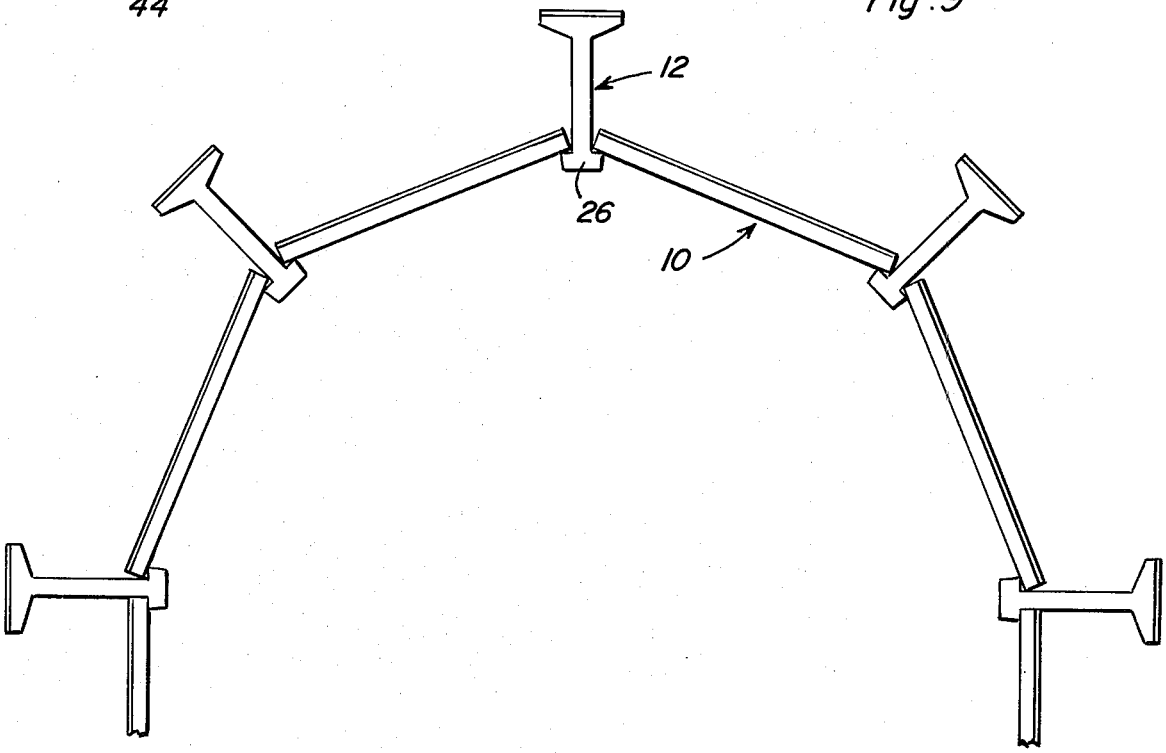
FIG. 9 is a top plan view showing the use of the tie blocks for producing a concave configuration.

Another variation which can be used with the retaining ties of the present invention is shown in FIG. 9 wherein a concave wall has been constructed by the use of a plurality of anchor blocks 12 and stringers 10. Obviously, since the stringers engage the rear surface of the forward small head 26 of each anchor block, an angular orientation can be established whereby the stringers are allowed to extend through a curve as shown. Back fill, of course, establishes a permanent engagement between the stringers and anchor blocks. In a similar fashion, a convex curve (not shown) can also be established.

Other readily apparent modifications include use of the 90° corner blocks 36 and 38 in making an outside corner as well as the inside corner shown in FIGS. 1 through 4. Also, the blocks 36, 38, can be used as a side wall for retaining land along the sides of a staircase. Furthermore, the entire retaining wall structures are capable of being built at an angle of approximately 80° with the horizontal such that the forward face of each level is angled rearwardly by approximately 10° to the vertical.

Other combinations and the various uses to numerous to mention will be obvious to one of ordinary skill in the art and are made capable by the unique design and construction of the retaining ties of the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A block retaining wall system including elongated first course blocks, second anchor blocks, third and fourth course blocks, each of said blocks being of the same heighth, said first blocks being of the same first predetermined length, said second blocks being of the same second predetermined length, said third blocks being of the same third predetermined length and said fourth blocks being of the same predetermined fourth length, said third and fourth blocks including half heighth downwardly and upwardly opening transverse notches, respectively, formed therethrough adjacent corresponding first sets of ends thereof, said first, third and fourth blocks including longitudinal inner and outer upstanding sides and longitudinal top and bottom horizontal surfaces, said inner sides including longitudinal notches formed therein opening through one set of corresponding surfaces and longitudinal projections projecting outwardly from the other set of corresponding surfaces with the projections of tiers of vertically stacked first, third and fourth blocks seated in the longitudinal notches of adjacent blocks of the corresponding tiers of blocks, said second anchor blocks including forward and rearward ends including small and large transverse dimension horizontally transversely enlarged heads, respectively, the rear ends of said second blocks including upstanding rear sides and horizontal upper and lower surfaces, said rear sides including notches formed therein and extending longitudinally therealong opening through one set of corresponding upper and lower surfaces thereof and projections extending longitudinally therealong projecting outwardly from the other set of corresponding upper and lower surfaces thereof with the last mentioned projections of the tiers of vertically stacked second blocks seated in the longitudinal notches of the adjacent large transverse dimension heads of corresponding tiers of second blocks, said second blocks being arrangeable with said small transverse dimension heads disposed forward of and lengthwise overlapping the outer sides of spaced ends of adjacent course blocks between which the forward ends of said second anchor blocks project, adjacent third and fourth blocks of each course of blocks having their half heighth notched ends interfitted with each other with the third and fourth blocks disposed generally at right angles to each other and in the same horizontal plane.

2. The combination of claim 1 wherein the lower marginal portions of said outer sides and said forward ends include full length lengthwise extending indentations formed therein.

3. The combination of claim 2 wherein said forward end small transverse dimension horizontally enlarged heads include front to rear extending end faces, each of said end faces including a lower marginal edge full length indentation formed therein corresponding to the first mentioned indentations.

4. A block retaining wall system including first course blocks and second anchor blocks, each of said blocks being of the same heighth, said first course blocks being of the same predetermined first length, said second blocks being of the same second predetermined length, said first blocks including longitudinal inner and outer upstanding sides and longitudinal top and bottom horizontal surfaces, said inner sides including longitudinal notches formed therein opening through one set of corresponding surfaces and longitudinal projections projecting outwardly from the other set of corresponding surfaces with the projections of the blocks of tiers of vertically stacked first blocks seated in the longitudinal notches of adjacent blocks of the corresponding tiers of blocks, said second anchor blocks including forward and rearward ends including small and large transverse dimention horizontally transversely enlarged heads, respectively, the rear ends of said second blocks including upstanding rear sides and horizontal upper and lower surfaces, said rear sides including notches formed therein and extending longitudinally therealong opening through one set of corresponding upper and lower surfaces thereof and projections extending longitudinally therealong projecting outwardly from the other set of corresponding upper and lower surfaces thereof with the last mentioned projections of the tiers of vertically stacked second blocks seated in the longitudinal notches of the adjacent large transverse dimension heads of corresponding tiers of second blocks, said second anchor blocks being arrangeable with said small transverse dimension heads disposed forward of and lengthwise overlapping the outer sides of adjacent spaced ends of courses of first blocks between which the forward ends of said second anchor blocks project.

* * * * *